US008747510B2

(12) United States Patent
Latham et al.

(10) Patent No.: US 8,747,510 B2
(45) Date of Patent: Jun. 10, 2014

(54) METHOD OF INSTALLING A MULTI-LAYER BATT, BLANKET OR MAT IN AN EXHAUST GAS AFTERTREATMENT OR ACOUSTIC DEVICE

(75) Inventors: Ruth Latham, Ann Arbor, MI (US); William Alcini, Ann Arbor, MI (US)

(73) Assignee: Tenneco Automotive Operating Company, Inc., Lake Forest, IL (US)

( * ) Notice: Subject to any disclaimer, the term of this patent is extended or adjusted under 35 U.S.C. 154(b) by 0 days.

(21) Appl. No.: 13/612,269

(22) Filed: Sep. 12, 2012

(65) Prior Publication Data

US 2014/0069067 A1 Mar. 13, 2014

(51) Int. Cl.

| | |
|---|---|
| ***B01D 50/00*** | (2006.01) |
| ***B01D 39/20*** | (2006.01) |
| ***B01D 39/14*** | (2006.01) |
| ***B01D 39/06*** | (2006.01) |
| ***B01D 39/00*** | (2006.01) |
| ***B01D 24/00*** | (2006.01) |

(52) U.S. Cl.

USPC ..... 55/523; 55/522; 55/524; 422/169; 422/170; 422/171; 422/172; 422/177; 422/178; 422/179; 422/180; 422/181; 422/182

(58) Field of Classification Search

USPC ..... 55/522–524; 422/169–172, 177–182

See application file for complete search history.

(56) References Cited

U.S. PATENT DOCUMENTS

| | | | | |
|---|---|---|---|---|
| 6,077,483 | A * | 6/2000 | Locker et al. | 422/179 |
| 6,967,006 | B1 * | 11/2005 | Wirth et al. | 422/179 |
| 2009/0022633 | A1 * | 1/2009 | Tomosue et al. | 422/177 |
| 2010/0209308 | A1 * | 8/2010 | Kunze et al. | 422/179 |
| 2011/0262691 | A1 * | 10/2011 | Naruse et al. | 428/116 |

* cited by examiner

*Primary Examiner* — Amber Orlando

(74) *Attorney, Agent, or Firm* — Wood, Phillips, Katz, Clark & Mortimer

(57) ABSTRACT

An exhaust treatment unit including a longitudinal core around an axis, a support mat, and powdered insulation impregnated between first and second layers of the support mat. In assembly, the mat is first wrapped around the core once, and powdered insulation is applied to the surface of the unwrapped portion of the mat prior to further winding whereby powdered insulation is disposed between mat layers after further winding.

14 Claims, 5 Drawing Sheets

METHOD OF INSTALLING A MULTI-LAYER BATT, BLANKET OR MAT IN AN EXHAUST GAS AFTERTREATMENT OR ACOUSTIC DEVICE

CROSS-REFERENCE TO RELATED APPLICATIONS

Not Applicable

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to exhaust treatment devices, and more particularly to such devices having a mat around an outer circumferential surface of a monolithic filter or monolithic catalytic carrier structure for supporting the structure within a housing.

BACKGROUND OF THE INVENTION

It is known in the automotive industry to include an exhaust gas treatment system utilizing gasoline particulate filters or diesel particulate filters and/or one or more catalytic units, such as a catalytic converter, diesel oxidation catalyst unit, or selective catalytic reduction catalyst unit to improve the emissions in the exhaust. In such catalytic units, it is common for a catalyst to be carried as a coating on a supporting substrate structure, such as a ceramic substrate having a monolithic structure, and in particulate filters it is common to employ a monolithic filter structure that can be non-catalytic.

Typically, such monolithic structures are oval or circular in cross section and are often wrapped with a layer of a support or mounting mat that is positioned between the monolithic structure and the outer housing of the unit to help protect the monolithic structure from shock and vibrational forces that can be transmitted from the housing to the monolithic structure. In addition, material to insulate and reduce the heat loss from the monolithic structure has been included with the support mat. One such structure is shown and described in U.S. Publication No. 2010-023946A1 which is hereby incorporated by reference. Typically, the support or mounting mat is made of a heat resistant and shock absorbing type material, such as a mat of glass fibers, ceramic fibers, or rock wool.

Manufacture of such structures can be difficult and costly. Further, such structures can break down and fail to provide the functional characteristics and properties desired before the useful life of, for example, the vehicle, is over. It is therefore advantageous to provide such monolithic structures which maximize their useful life.

SUMMARY OF THE INVENTION

In one aspect of the present invention, an exhaust treatment unit for treating an exhaust gas from a combustion process is provided, including a core, a support mat, and insulation. The core has a longitudinal axis and a longitudinally extending outer surface circumferential around the longitudinal axis. The support mat has a width extending parallel to the core longitudinal axis, and includes a first layer wrapped circumferentially around the core outer surface, and a second layer wrapped circumferentially around the first layer. The insulation is powdered insulation and impregnated between the support mat first and second layers.

In one form of this aspect of the invention, an innermost layer of powdered insulation is impregnated between the outer surface of the core and the support mat first layer.

In another form of this aspect of the invention, a housing surrounds an outermost layer of the support mat wrapped around the core.

In another aspect of the present invention, a method is provided for mounting a support mat within a space between a core and an outer housing of an exhaust gas after-treatment or acoustic device is provided, where the space has an inner surface and an outer surface spaced from the inner surface, and the inner surface extends around a longitudinal axis and has a circumference about the axis. The method steps include (1) providing a support mat with a length between a first end and a second end and opposite first and second surfaces between the support mat ends, the length being at least greater than twice the circumference of the device inner surface, (2) wrapping the support mat around the inner surface from the mat first end with the mat first surface facing the device inner surface, (3) prior to wrapping the support mat around the inner surface more than about one time, applying a layer of powdered insulation to the mat second surface beginning at a distance of about the inner surface circumference from the mat first end and for a distance of at least the inner surface circumference, and (4) compressing the mat between the inner surface and the outer surface of the device.

In one form of this aspect of the invention, the wrapping step includes (a) first wrapping the support mat around the inner surface about one time, and (b) then wrapping the remainder of the support mat around itself and the device inner surface until the entire mat is wrapped in a generally spiral configuration around the device inner surface, where the insulation layer applying step is performed after the first wrapping step and before the step of wrapping the remainder of the support map. In a further form, the powdered insulation layer applying step applies the powdered insulation along the length of the remainder of the support mat. In another further, the powdered insulation layer applying step applies the powdered insulation across substantially the full width of the mat second surface. In still another further form the powdered insulation layer applying step applies the powdered insulation across less than the full width of the mat second surface whereby side edges of the mat second surface have substantially no powdered insulation applied.

In another form of this aspect of the invention, the initial wrapping step comprises wrapping the mat around the longitudinal axis of the device 360° to 370°.

In still another form of this aspect of the invention, the powdered insulation is impregnated into the support mat.

DETAILED DESCRIPTION OF THE PREFERRED EMBODIMENT

Figure 1:
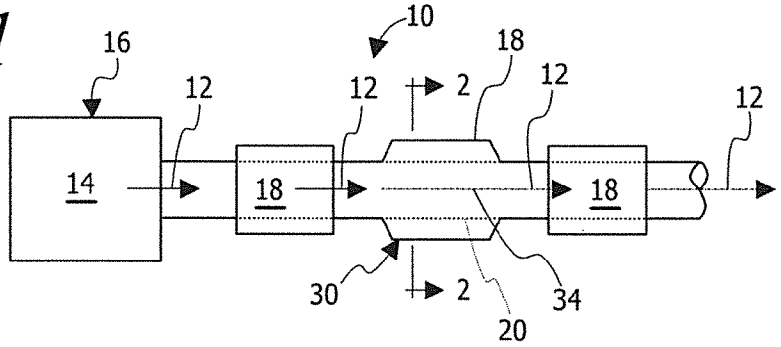
FIG. 1 is a diagrammatic representation of an exhaust gas system in which the present invention is incorporated.

An exhaust gas system 10 is shown in FIG. 1 in the form of a diesel exhaust gas aftertreatment system to treat the exhaust 12 from a combustion process 14, such as occurs with a diesel engine 16. The exhaust 12 of the combustion process 14 will typically contain a variety of by-products, including oxides of nitrogen ($NO_x$) (such as nitric oxide [NO] and nitrogen dioxide [$NO_2$] among others), particulate matter (PM), hydrocarbons, carbon monoxide (CO).

The system 10 includes one or more exhaust gas acoustic and/or aftertreatment devices or components 18, examples of which include catalytic converters, diesel oxidation catalysts, diesel particulate filters (DPF), gas particulate filters, lean $NO_x$ traps, selective catalytic reduction monoliths, burners, manifolds, connecting pipes, mufflers, resonators, tail pipes, emission control system enclosure boxes, insulation rings, insulated end cones, insulated end caps, insulated inlet pipes, and insulated outlet pipes, all of any cross-sectional geometry. As those skilled in the art will appreciate, some of the foregoing devices 18 may be strictly metallic components with a central core 20 through which the exhaust 12 flows, whereas other such devices 18 may include a core 20 in the form of a ceramic monolithic structure and/or a woven metal structure through which the exhaust 12 flows. These devices 18 may be advantageously used, for example, in motor vehicles (diesel or gasoline), construction equipment, locomotive engine applications (diesel or gasoline), marine engine applications (diesel or gasoline), small internal combustion engines (diesel or gasoline), and stationary power generation (diesel or gasoline)

Figure 2:
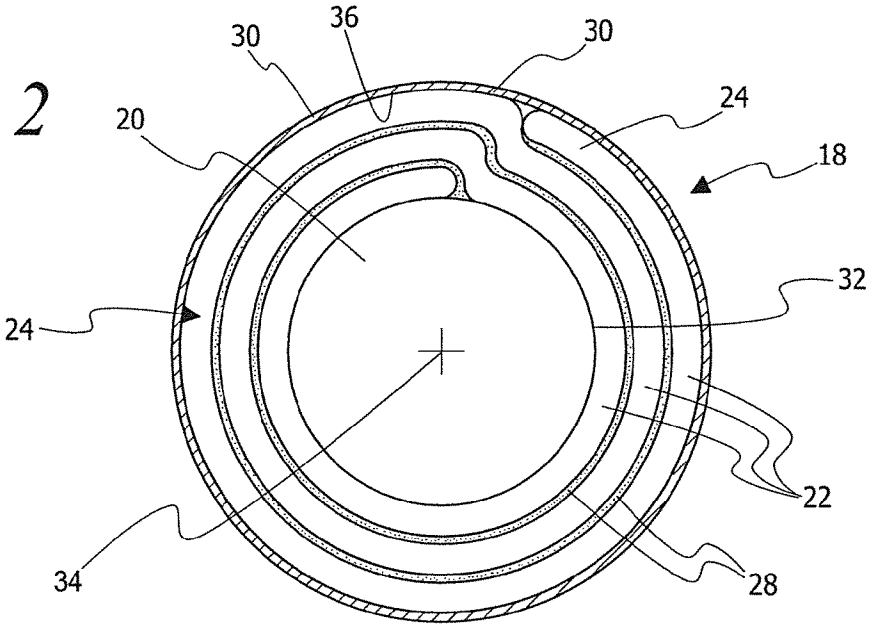
FIG. 2 is a cross-sectional view taken along line 2-2 of FIG. 1 showing an exhaust system component incorporating the present invention.

As shown in FIG. 2, the aftertreatment device 18 according to the present invention includes a core 20, at least two layers 22 of a continuous support or mounting mat 24, and at least one layer of powdered insulation 28 sandwiched between, and impregnated into, at least two adjacent layers 22 of the support mat 24, with the mat layers 22 compressed inside an outer housing 30.

Advantageously, the powdered insulation 28 may reduce the effective thermal conductivity between the layers 22 and from the core 20 and exhaust gas 12, as well as reducing the radiant heat transfer from the core 20 and exhaust gas 12. This can be beneficial for maintaining the temperature of the exhaust gas 12 and the core 20 within temperature ranges that are suitable, and preferably optimal, for a desired catalytic reaction(s) if, for example, the core 20 includes a catalyst. In some applications, however, it may be desirable that the powdered insulation 28 not substantially reduce the effective thermal conductivity between the layers 22 and/or from the core 20 and exhaust gas 12.

The core 20 can be of any suitable type and construction as necessitated by the aftertreatment device 18. In the embodiment illustrated in FIG. 2, the core 20 is a monolithic structure of porous ceramic carrying a catalyst coating that is suitable for the intended function of the system 10, such as, for example, a suitable oxidation catalyst or a suitable selective catalytic reduction catalyst.

The core 20 may advantageously have a boundary surface 32 that extends parallel to a longitudinal axis 34 which will typically coincide with the flow direction of the exhaust 12 through the unit 10. The boundary surface 32 in cross-section of the core through the axis 34 may, for example, be oval, elliptical, triangular, rectangular, or hexagonal. In the FIG. 2 embodiment, the core 20 is cylindrical with the boundary surface 32 circular in cross-section centered on the axis 34.

The support mat 24 and powdered insulation 28 are sandwiched in a space defined by concentric inner and outer surfaces, where the inner surface is the core boundary surface 32 and the space outer surface is the inside surface 36 of the outer housing 30. It should be appreciated that the space may be ring shaped in cross-section, when the core 20 and housing 30 are cylindrical, though the space could have other shapes based on the shape of the core 20 and housing 30, including, for example, be oval, elliptical, triangular, rectangular, or hexagonal. The mat 24 and powdered insulation 28 help, inter alia, to protect the core 20 from shock and vibrational forces that can be transmitted from the housing 30 to the core 20.

The support mat 24 may be made from any suitable material, many of which are known, including, for example, glass fiber mats, rock wool mats, or ceramic fiber mats, such as for example, refractory ceramic fibers, mullite ceramic fibers, or other high alumina ceramic fibers. The powdered insulation 28 consists of a suitable insulating material in powder form such as, for example, microporous insulation. Such insulation 28 can include a titanium rutile mixture, a titanium oxide mixture, or aerogel insulation (including commercially available insulation products such as those sold commercially under the mark Microtherm®).

If the system 10 includes more than one layer of insulation 28, each insulation layer may advantageously be made from the same powdered material, although it should be appreciated that it would be within the scope of the present invention to have the insulation material of one or more layers to be different from the insulation material of other layer(s).

Figure 3A:
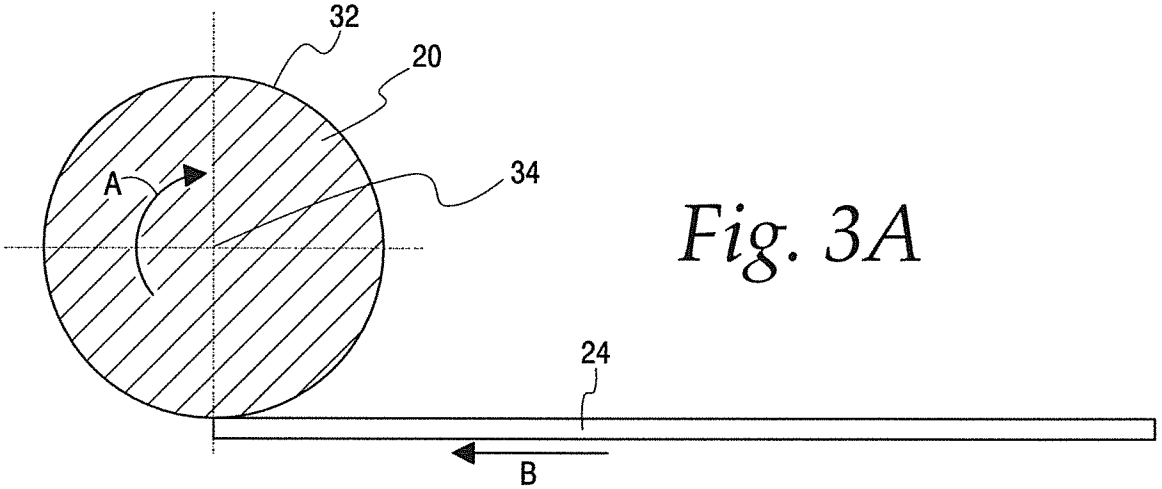
FIG. 3A is a side view of the exhaust system component before the mat is wrapped around the core pursuant to the present invention.
Figure 3B:
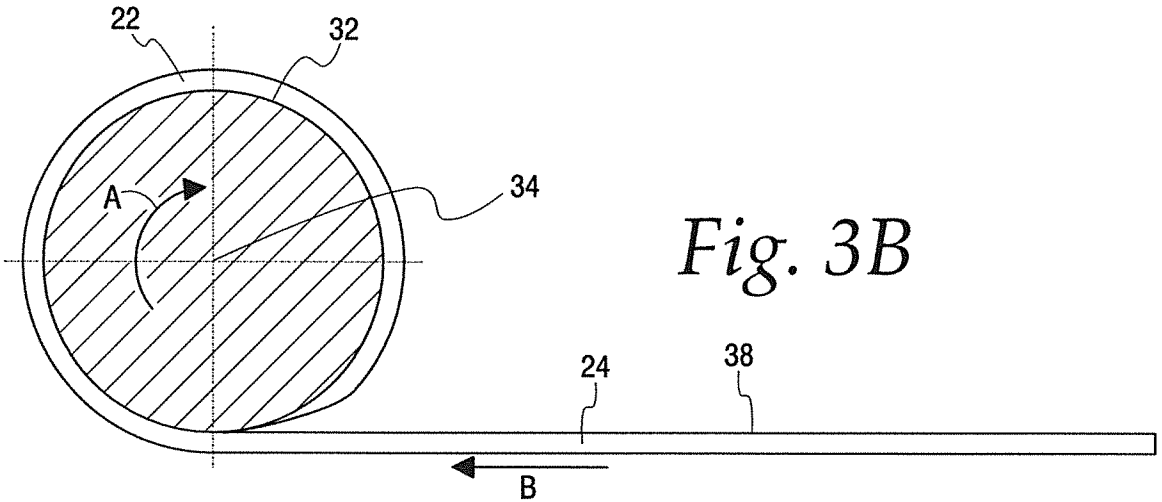
FIG. 3B is a side view of the exhaust system component of FIG. 3A after the mat has been wrapped one revolution around the core.

FIGS. 3A-3B illustrate one advantageous one method of assembling the aftertreatment device 18. In this method, a first layer 22 of the support mat 24 is wrapped around the core 20 by rotating the core 20 about the axis 34, as shown by arrow A, while supplying the support mat 24 at a suitable speed, as shown by arrow B. After a complete revolution (e.g., wrapping the mat 24 around the longitudinal axis 34 about 360° to 370°), one layer 22 of the mat 24 will be completely wrapped around the core 20, as illustrated in FIG. 3B, at which point a layer 26 of powdered insulation 28 is then applied to the unwrapped exposed surface 38 of the support mat 24.

The powdered insulation 28 can be advantageously applied by, for example, misting or dusting the insulation 28 about the surface 38 of the support mat 24. The portable nature of powdered insulation 28 enables for the straightforward application of the powdered insulation 28 during the wrapping process as described herein. Moreover, the powdered insulation 28 may be advantageously applied so that it is impregnated into the support mat 24.

Figure 4B:
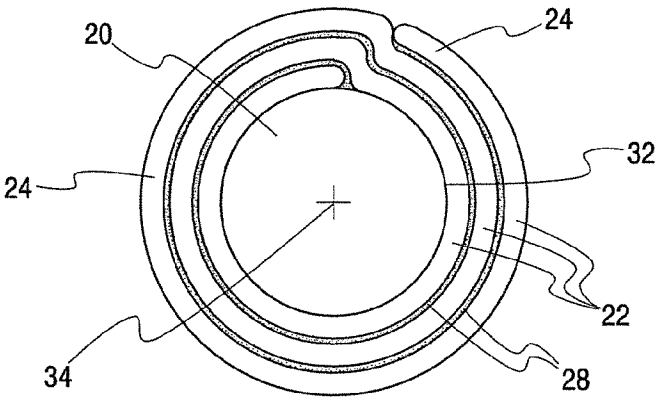
FIG. 4B is a side view of the exhaust system component of FIG. 4A where the mat has been completely wrapped around the core.

The mat 24 is then further wrapped around the core 20 by continued rotation of the core 20 in the direction of arrow A until it is completely wrapped around the core 20 in a generally spiral configuration (due to the thickness of the materials a precisely spiral configuration may not result, as illustrated, e.g., in FIG. 4B). It should be appreciated that the powdered insulation 28 will be located between at least one set of adjacent layers 22 of the mat 24.

It should be appreciated that application of the powdered insulation 28 to the mat surface 38 may be accomplished while the mat 24 is being wrapped (i.e., while the core 20 is rotating), or wrapping may be stopped for the application of the powdered insulation. In either process, the powdered insulation 28 is applied only to desired areas of the exposed surface 38 of the mat 24. If applied, for example, during wrapping, a suitable insulation application device may be activated to apply insulation 28 only when the portion of the mat 24 on which insulation 28 is desired passes the application device. Alternatively, for example, misting of the insulation 28 over a broad area of the mat surface 38 may be activated after the first layer 22 of the mat 24 is wrapped around the core 20.

After the mat 24 is fully wrapped around the core 20 with desired layers of insulation 28 between the mat layers 22, the entire structure may then be assembled into the housing 30 by suitably compressing the mat 24 to mount the core 20 and mat 24 in the housing 30 (see FIG. 2).

Figure 4A:
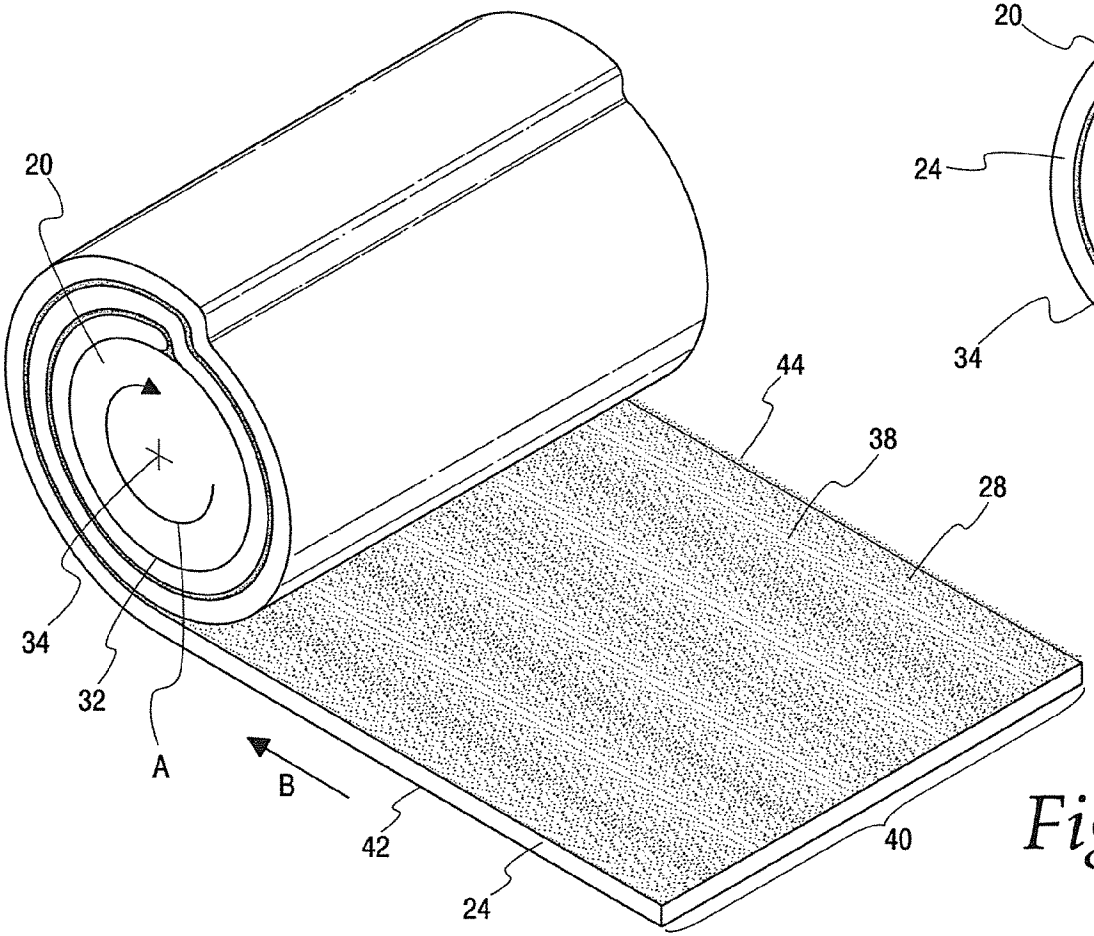
FIG. 4A is an isometric view of an exhaust system component as a mat is wrapped around the core pursuant to one embodiment of the invention.

The above described method may be practiced to manufacture the embodiment shown in FIGS. 4A-4B, wherein the powdered insulation 28 is applied to the entire exposed surface 38 of the support mat 24 such that the powdered insulation 28 is evenly distributed across the entire width 40 of support mat 24, as well as the entire length of the mat 24, after the mat 24 is wrapped around the core 20 once.

Figure 5B:
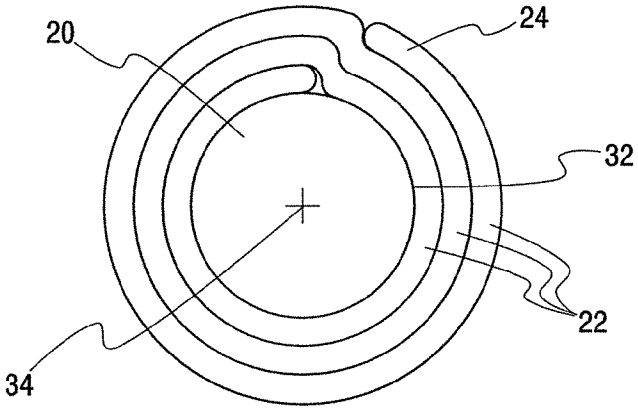
FIG. 5B is a side view of the exhaust system component of FIG. 5A where the mat has been completely wrapped around the core.
Figure 5A:
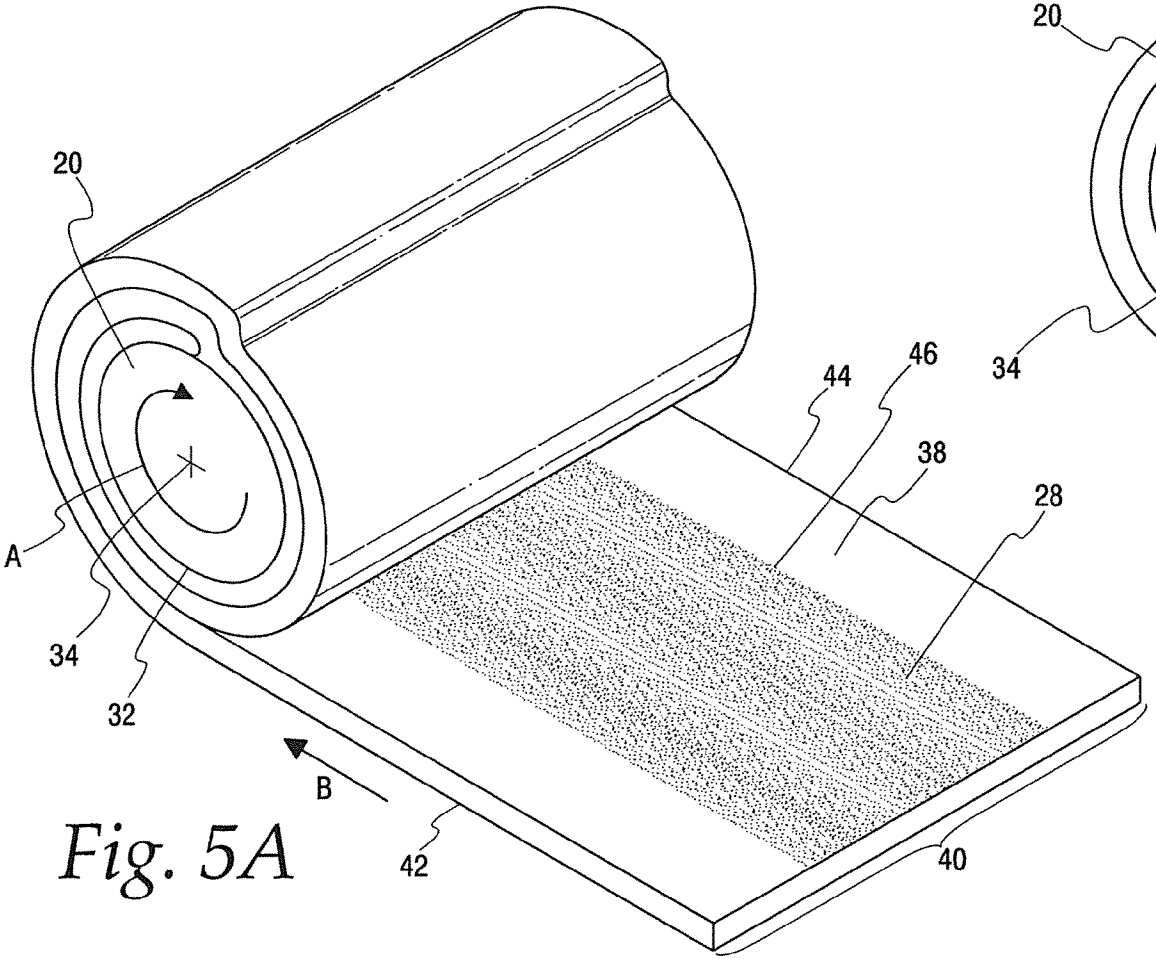
FIG. 5A is an isometric view of an exhaust system component as the mat is wrapped around the core pursuant to a second embodiment of the invention.

FIGS. 5A-5B illustrate another configuration in which the powdered insulation 28 is applied to the exposed surface 38 of the support mat 24 along only a central portion, offset from the side edges 42, 44 of the support mat 24. Spacing the powdered insulation 28 from the side edges 42, 44 of the mat helps to prevent the powdered insulation 28 from being directly exposed to the hot gases in the exhaust stream once the support mat 24 is fully wrapped around the core 20 and inserted into the housing 30. Manufacture and assembly of an aftertreatment device 18 including the structure illustrated in FIGS. 5A-5B may be otherwise accomplished in the same manner as described with respect to FIGS. 3A-3B.

Figure 6B:
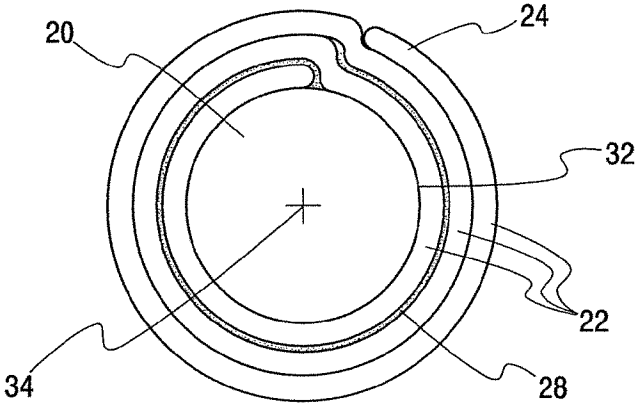
FIG. 6B is a side view of the exhaust system component of FIG. 6A where the mat has been completely wrapped around the core.
Figure 6A:
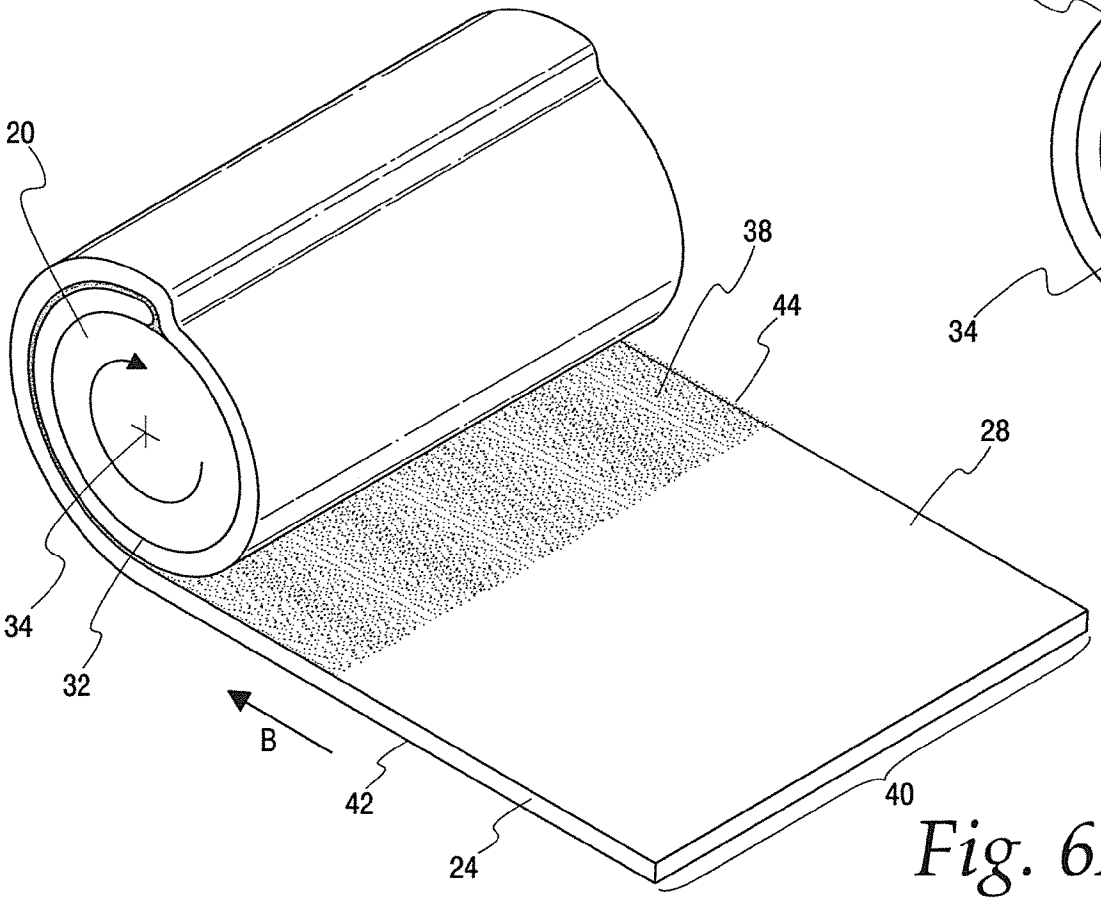
FIG. 6A is an isometric view of an exhaust system component as the mat is wrapped around the core pursuant to a third embodiment of the invention.

FIGS. 6A-6B illustrate a still different configuration in which the powdered insulation 28 is applied to the exposed surface 38 of the support mat 24 along only a limited length of the mat 24—for example, for only the length about equal to one revolution of the mat 24 around the core 20. In such a configuration, a layer of insulation 28 will be formed between only two adjacent layers 22 of the mat 24 (i.e., the layer of insulation 28 will go around the core 20 for only about one revolution). Manufacture and assembly of an aftertreatment device 18 including the structure illustrated in FIGS. 6A-6B may be otherwise accomplished in the same manner as described with respect to FIGS. 3A-3B.

It should also be appreciated that while the invention has been described herein in connection with a diesel combustion process in the form of a diesel compression engine 16, the invention may find use in devices that are utilized in exhaust gas systems for other types of combustion processes, including other types of internal combustion engines, including, for example, internal combustion engines that use gasoline or other alternative fuels.

Further it should be appreciated that the above described structures may be manufactured, and the methods may be accomplished, easily and inexpensively. For example, application of powdered insulation may be easily and more quickly accomplished than, for example, inserting a continuous sheet of insulation. Moreover, not only may powdered insulation be readily applied to the exact area desired, but it may be done so without the waste which can result from use of sheets of insulation (which may need to be trimmed to fit the size of the particular device being manufactured) and can also be accomplished without requiring inventories of different sizes of insulations sheets (or rolls) for each different size of aftertreatment devices.

What is claimed is:

1. An exhaust treatment unit for treating an exhaust gas from a combustion process, the exhaust treatment unit comprising:

a core having a longitudinal axis, said core further including a longitudinally extending outer surface circumferential around said longitudinal axis;

a continuous support mat having an inner surface and oppositely facing outer surface, said inner and outer surfaces having a width extending parallel to the core longitudinal axis and a length at least twice the circumference of the core outer surface, and including a first layer wrapped circumferentially around the core outer surface with its inner surface adjacent said core, and a second layer wrapped circumferentially around the first layer; and at least one layer of powdered insulation impregnated on selected areas of one of said inner and outer surfaces of the continuous support mat, said selected areas comprising less than the entirety of the one of said inner and outer surfaces of the continuous support mat.

2. The exhaust treatment unit of claim 1 further comprising an innermost layer of powdered insulation impregnated between the outer surface of the core and the support mat first layer.

3. The exhaust treatment unit of claim 1 further comprising a housing surrounding an outermost layer of said support mat wrapped around the core.

4. A method of mounting a support mat within a space between a core and an outer housing of an exhaust gas aftertreatment or acoustic device, said space having an inner surface and an outer surface spaced from the inner surface, said inner surface extending around a longitudinal axis and having a circumference about said axis, the method comprising the steps of:

providing a support mat with a length between a first end and a second end and opposite first and second surfaces between said support mat ends, said length being at least greater than twice the circumference of the device inner surface;

wrapping said support mat around said inner surface from said mat first end with said mat first surface facing said device inner surface;

prior to wrapping said support mat around said inner surface more than about one time, applying a layer of powdered insulation to the mat second surface beginning at a distance of about the inner surface circumference from the mat first end and for a distance of at least said inner surface circumference; and compressing the mat between the inner surface and the outer surface of the device.

5. The method of claim 4, wherein:

said wrapping step comprises first wrapping said support mat around said inner surface about one time, and then wrapping the remainder of said support mat around itself and the device inner surface until the entire mat is wrapped in a generally spiral configuration around the device inner surface, and said insulation layer applying step is performed after said first wrapping step and before the step of wrapping the remainder of the support map.

6. The method of claim 5, wherein said powdered insulation layer applying step applies said powdered insulation along the length of the remainder of the support mat.

7. The method of claim 5, wherein said powdered insulation layer applying step applies said powdered insulation across substantially the full width of the mat second surface.

8. The method of claim 5, wherein said powdered insulation layer applying step applies said powdered insulation across less than the full width of the mat second surface whereby side edges of the mat second surface have substantially no powdered insulation applied.

9. The method of claim 4 wherein the initial wrapping step comprises wrapping the mat around the longitudinal axis of the device 360° to 370°.

10. The method of claim 4 wherein the powdered insulation is impregnated into the support mat.

11. The exhaust treatment unit of claim 1, wherein the selected areas of the continuous support mat include the area between the support mat first and second layers.

12. The exhaust treatment unit of claim 1, wherein the selected areas of the area between the support mat first and second layers are spaced from longitudinal side edges of said continuous support mat.

13. The exhaust treatment unit of claim 1, wherein the selected areas of the continuous support mat exclude areas adjacent longitudinal side edges of said continuous support mat.

14. The exhaust treatment unit of claim 1, wherein the selected areas of the continuous support mat exclude areas between the core outer surface and the mat first layer.

* * * * *